United States Patent [19]

Zepp

[11] 4,011,423

[45] Mar. 8, 1977

[54] COMMON RESET EXTENSION FOR PLURALITY OF OVERLOAD RELAYS

[75] Inventor: Robert Glenn Zepp, Finksburg, Md.

[73] Assignee: I-T-E Imperial Corporation, Spring House, Pa.

[22] Filed: Sept. 12, 1975

[21] Appl. No.: 612,943

[52] U.S. Cl. ..... 200/330; 200/337; 200/340; 200/50 A

[51] Int. Cl.[2] ..... H01H 3/20

[58] Field of Search ..... 200/5 E, 153 T, 18, 200/50 C, 328, 330, 331, 333, 337, 338, 340, 153 LA, 50 A, 61.62, 61.7

[56] References Cited

UNITED STATES PATENTS

| | | | |
|---|---|---|---|
| 3,142,732 | 7/1964 | Clarke et al. | 200/50 C |
| 3,294,926 | 12/1966 | Dellert et al. | 200/337 |
| 3,867,598 | 2/1975 | Richards | 200/337 |
| 3,937,913 | 2/1976 | Soulas | 200/340 |

*Primary Examiner*—Gerald P. Tolin
*Attorney, Agent, or Firm*—Ostrolenk, Faber, Gerb & Soffen

[57] ABSTRACT

An assembly of overload relays is mounted so that the reset handles are spaced a substantial distance from the operable cover of the enclosure wherein the relays are mounted. A reset extension is provided for resetting all relays simultaneously by depressing a single reset button mounted on the cover. The reset extension is constructed so as to be self securing to the overload relays, and is mounted and dismounted without requiring tools.

7 Claims, 12 Drawing Figures

COMMON RESET EXTENSION FOR PLURALITY OF OVERLOAD RELAYS

Figure 1:
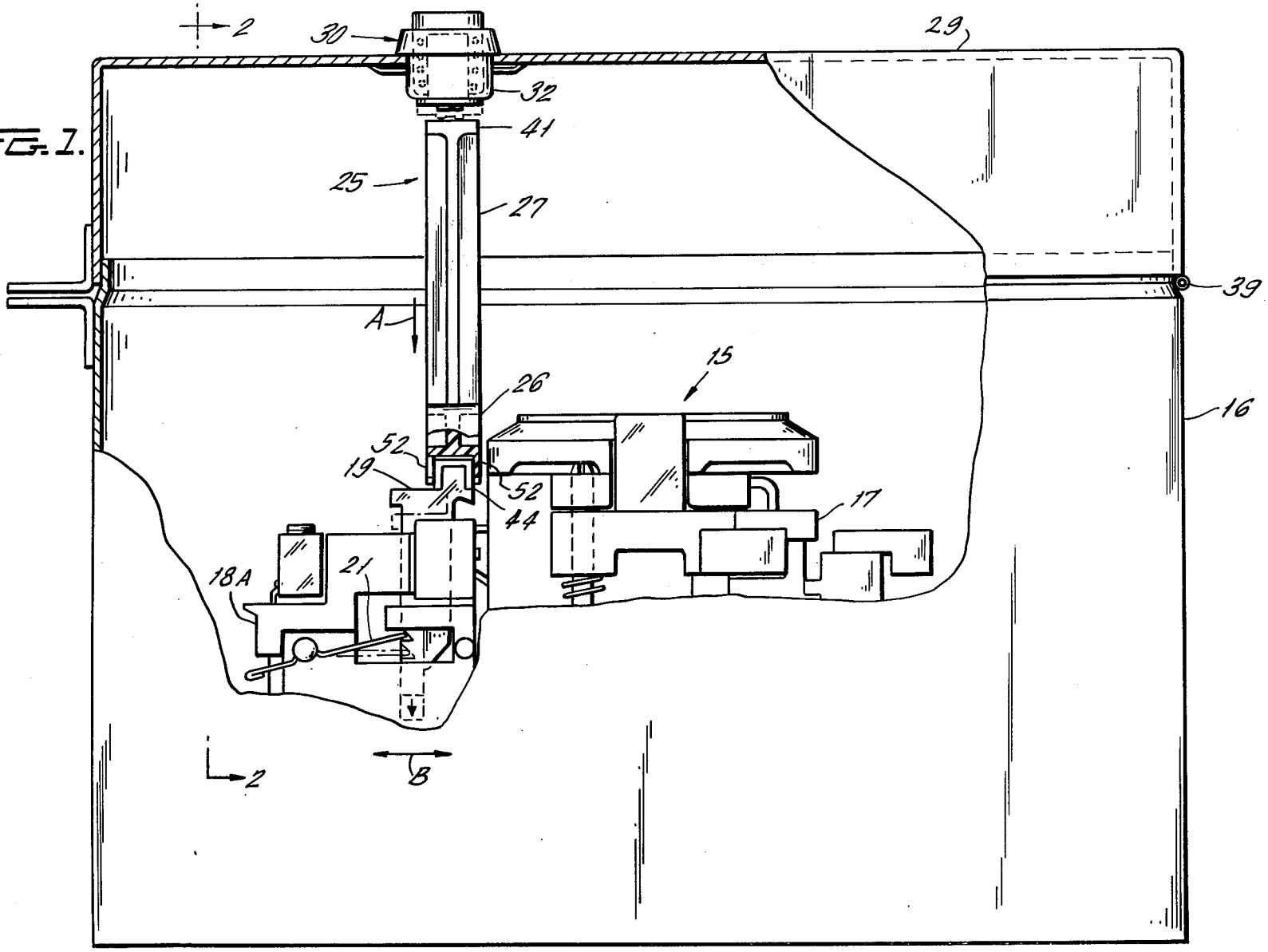

U.S. Pat. No. 3,324,431 issued June 6, 1967 for an Electromagnetic Contactor Having Interchangeable Auxiliary Devices, discloses a motor starter having a three pole electromagnetic contactor and three single pole overload relays mounted to the contactor. Starters of this type are often incorporated in a drawout unit that forms part of a motor control center of the type illustrated in U.S. Pat. No. 3,363,147 issued Jan. 9, 1968 to J. B. Cataldo et al. for a *Motor Control Combination Unit For Motor Control Centers*. Normally the drawout unit is disposed behind a hinged door of the control center and this door mounts a single pushbutton for simultaneous manual resetting of all three overload relays. When the motor starter is mounted so that the overload relay reset handles are close to the openable door, it is a simple matter to provide a reliable connection between the door mounted reset button and the reset handles of the overload relays. However, when there is substantial spacing between the door and the reset handles a reset extension must be provided.

Traditionally, the prior art has provided reset extensions that are mounted to the enclosure door. When the door is opened the service man's attention is directed to withdrawing the drawout unit for servicing same and under such circumstances the extension projecting from the door is susceptible to breakage. Further, in many control centers opening of the doors is limited to 90 degree movement. Under such circumstances, the reset extension will project into the path required for withdrawing the drawout unit so that before the withdrawal operation may be performed, it is necessary to dismount the reset extension. This is a time consuming operation and very often the reset extension is misplaced after removal.

In order to overcome the above noted disadvantages of the prior art, the instant invention provides a common reset extension that is mounted to the reset handles of the overload relays. This reset extension is constructed so as to be readily removable and to be readily securable to the overload relays without the utilization of any tools.

Briefly, the instant invention provides a common reset extension including a bar having formations to receive the free ends of the overload relay reset handles, and a projection extending forward of the bar to a position adjacent to a depressable reset control button mounted to the openable cover of the enclosure wherein the motor starter is mounted. The free end of each overload relay handle is provided with an undercut formation. The undercut formation of the center overload relay is received by an open-sided recess in the bar having a shape which complements that of the undercut portion so that with respect to all but sideways movement the reset extension is captured by the reset handle of the center overload relay. The reset handles of the outer overload relays are received by pockets in the reset extension through rear entrances thereof. These pockets are provided with boundary formations which cooperate with the reset handles to prevent side to side movement of the common reset extension. Thus, the recess and pockets are so constructed that their boundaries cooperate with the undercut formations of the reset handles to self secure and removably mount the reset extension to the overload relays.

Accordingly, a primary object of the instant invention is to provide a novel construction for a reset extension that is mounted to a plurality of overload relays.

Another object is to provide a reset extension of this type constructed to be self secured to a plurality of overload relays.

Still another object is to provide a reset extension of this type that is readily mountable and dismountable from a plurality of overload relays.

A further object is to provide a reset extension of this type that need not be dismounted when a drawout unit is removed from its controls.

These objects as well as other objects of this invention shall become readily apparent after reading the following description of the accompanying drawings in which:

FIG. 1 is a plan view showing the common reset extension of the instant invention mounted to a motor starter disposed within an enclosure having an openable cover.

Figure 3:
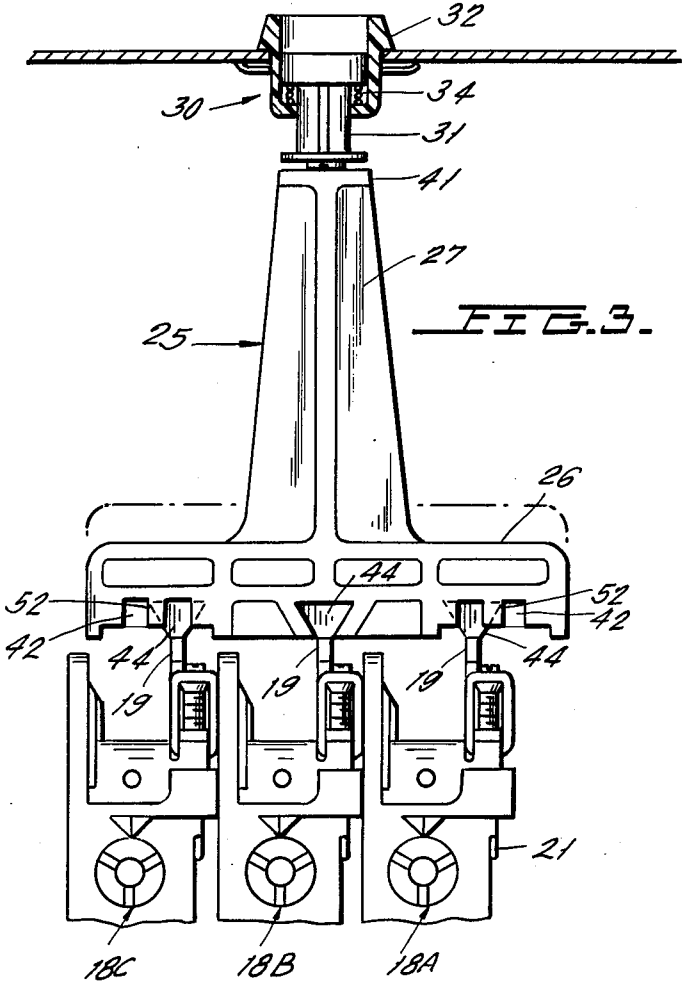
Figure 2:
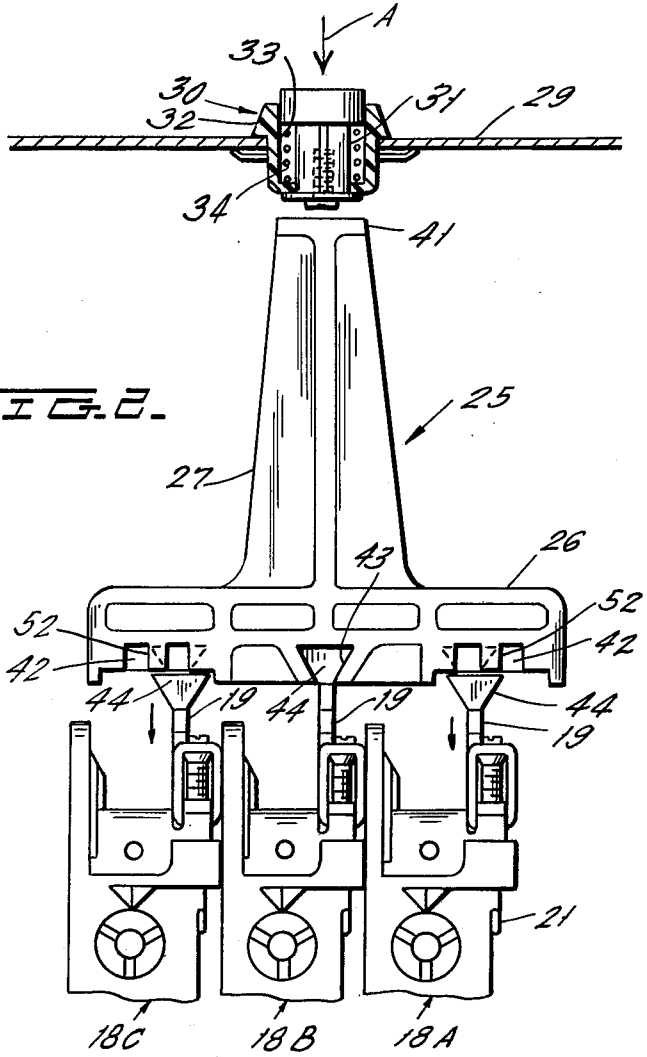

FIGS. 2 and 3 are partial side elevations taken through lines 2—2 of FIG. 1 looking in direction of arrows 2—2. In FIG. 2, the common reset extension is shown being mounted to three overload relays and in FIG. 3 the common reset extension is shown being used to simultaneously reset three overload relays.

Figure 4:
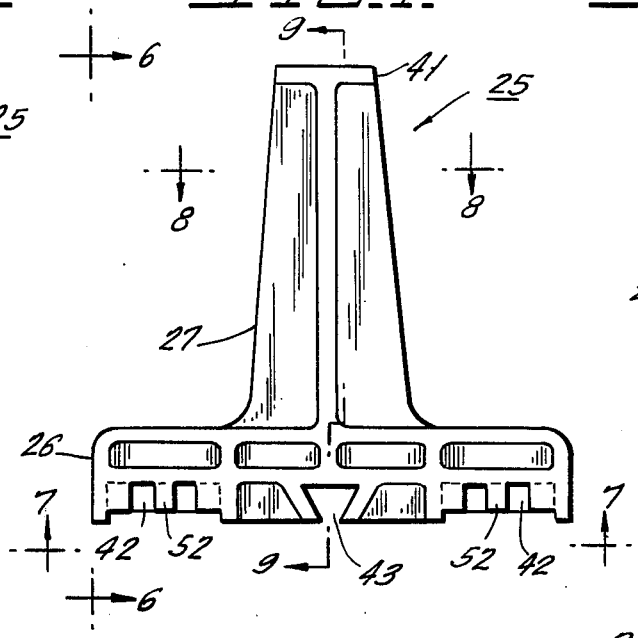

FIG. 4 is a side elevation of the common reset extension.

Figure 5:
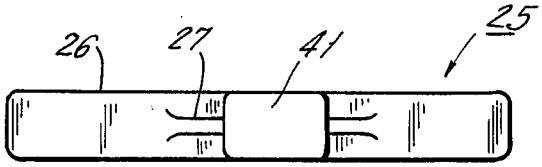
Figure 6:
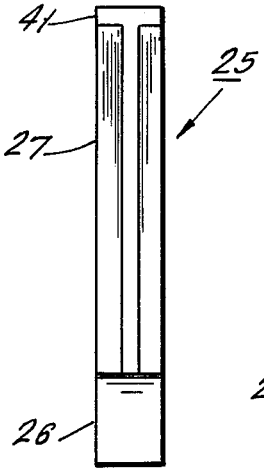
Figure 7:
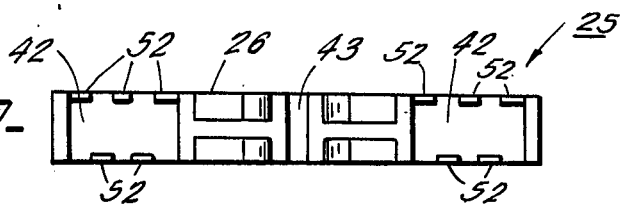

FIGS. 5, 6 and 7 are front, end and rear elevations, respectively, of the common reset extension looking in the directions of the respective arrows 5—5, 6—6 and 7—7 of FIG. 4.

Figure 8:
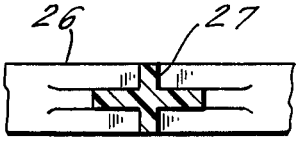
Figure 9:
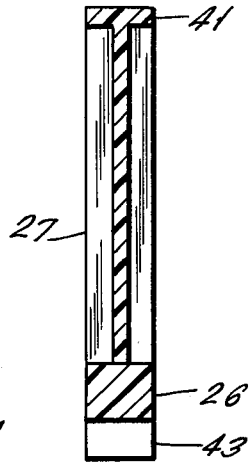

FIGS. 8 and 9 are cross-sections taken through the respective lines 8—8 and 9—9, respectively, looking in the directions of the respective arrows 8—8 and 9—9.

Figure 10:
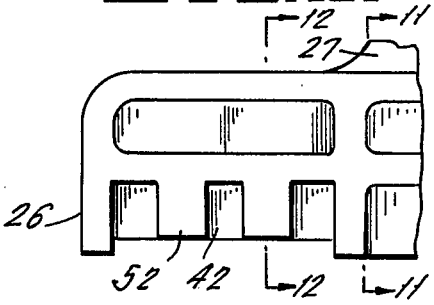

FIG. 10 is an enlarged fragmentary side elevation of the common reset extension of FIG. 4.

Figure 12:
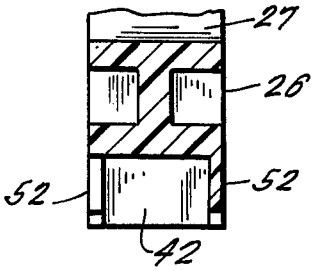
Figure 11:
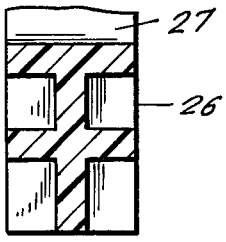

FIGS. 11 and 12 are cross-sections taken through lines 11—11 and 12—12, respectively, of FIG. 10 looking in a direction of arrows 12—12.

Now referring to the figures. Motor starter 15, mounted within enclosure 16 on the rear wall thereof, includes three pole electromagnetic contactor 17 and three identical overload relays 18A, 18B, and 18C. Contactor 17 and overload relays 18A-C have constructions generally of the types illustrated in the aforesaid U.S. Pat. No. 3,324,431.

Each of the overload relays 18A–C is provided with a reset handle 19 that is biased in a forward direction by spring 21 and is manually depressible in a rearward direction indicated by arrow A-1 to reset the switch contacts of the overload relay after the latter is tripped because of being subjected to an overload condition.

Overload relays 18A–C are mounted side by side with their handles 19 being engaged by transverse bar section 26 of common reset extension 25 molded of plastic insulating material. The latter is also provided with projection 27 extending forward and at right angles to bar 26, terminating adjacent to the rear end of movable section 31 of pushbutton control means 30. The latter is mounted to openable front cover front cover 29 of enclosure 16 and also includes section 32 which extends through cover aperture 33 and is fixably secured to cover 29. Hinge means 39 operatively mounts cover 29. Coil spring 34 biases movable section 31 forward and permits the latter to be manually depressed in a rearward direction to engage the forward end of reset extension 25 to move the latter rearward thereby simultaneously moving all three reset handles 19 rearward to reset those overload relays 18A–C that have tripped.

Forward projection 27 is of cruciform cross-section (FIG. 8) except that the forward end thereof is provided with platform 41 (FIG. 5) which is engageable by movable pushbutton section 31. The rear surface of transfer bar section 26 is provided with a pair of pockets 42—42 and recess 43 disposed between pockets 42—42. The latter receives undercut formations 44 at the free ends of reset handles 19—19 of outer overload relays 18A and 18C, and undercut formation 44 of the center overload relay 18B is disposed within recess 43. Formations 44 are referred to as being undercut in that the rear ends thereof are narrower than more forwardly portions thereof.

The shape of recess 43 is complementary to that of undercut portion 44 and cooperates therewith in limiting to sideways directions relative movement between reset extension 25 with reset handle 19 of overload relay 18B. To operatively mount reset extension 25, outer handles 19—19 are moved to the rear of formations 52 forming the side boundaries of pockets 42—42 (FIG. 2). This enables extension bar 26 to move sideways with the center undercut section 44 entering recess 43 through one or the other of the trapezoidal open sides thereof. Now the only relative movement that may take place between reset extension 25 and handle 19 of overload relay 18B is from side to side or in the directions indicated by the double headed arrow B in FIG. 1. When outer undercut formations 44—44 are released, they move forward into pockets 42—42 (FIG. 3) because of the biasing forces provided by springs 21 acting on reset handles 19. Now, if an attempt is made to move reset extension 25 in either sideways direction indicated by double headed arrow B, the side informations 52 will engage outer undercut formations 44—44 to block this sideways movement. Thus, it is seen that except during mounting and dismounting of reset extension 25, the latter is operatively secured to motor starter 15 in a manner such that effectively there cannot be any relative movement between reset extension 25 and rest handles 19 of overload relays 18A–18C.

Although the instant invention has been described in connection with a reset extension in which the transverse bar section is provided with an undercut recess disposed between a pair of pockets, it should now be apparent to those skilled in the art that devices following teachings of the instant invention may be constructed with various combinations including one or more recesses and one or more pockets.

Thus, it is seen that the instant invention provides a novel construction for a common reset extension mounted to the overload relays of a motor starter in a manner such that no tools are required for mounting or dismounting. The extension is said to be self-retained in that additional elements, such as screws, are not required to insure that the extension remains secured in operative engagement with the circuit breaker handles. Further, when the door of the enclosure for the motor starter is open, the reset extension will not interfere with removal of the motor starter from the enclosure and the reset extension is not likely to be damaged.

In the foregoing, the invention has been described solely in connection with preferred illustrative embodiments thereof. Since many variations and modifications of the present invention will now be obvious to those skilled in the art, it is preferred that the scope of the invention be determined not by the specific disclosure herein contained but only by the appended claims.

What is claimed is:

1. Electrical switching apparatus including housing means having an openable front cover, a plurality of switches mounted within said enclosure with each having a rearwardly depressible reset handle, a control mounted on said cover so as to be movable therewith and operable from outside of said housing means said switches being disposed with their handles remote from said cover and said control, a common reset extension means operatively mounted to said switches extending forward thereof for operative engagement by said control to transmit rearward movement of the latter to said handles for resetting said switches, with said cover open, said control being remote from said extension means and the latter remaining mounted to said switches.

2. Electrical switching apparatus as set forth in claim 1 in which the extension means is self-retained to said switches.

3. Electrical switching apparatus as set forth in claim 1 in which the extension means includes a first section operatively engaging said handles and a second section extending forward of said first section for operative engagement by said control, said first section including a recess having a side opening through which a first of said handles enters said recess and a pocket having a rear opening through which a second of said handles enters said pocket.

4. Electrical switching apparatus as set forth in claim 3 in which undercut portions of said first and second handles extend into said recess and said pocket, said recess having a shape to complement said undercut portion whereby cooperation between said undercut portion of said first handle and said boundaries of said recess limits relative movement between said extension means and said switches to sideways directions.

5. Electrical switching apparatus as set forth in claim 4 in which boundary portions of said pocket cooperate with said second handle to block sideways movement of said extension means relative to said switches.

6. Electrical switching apparatus as set forth in claim 5 in a single molded insulating member constitutes said extension means.

7. Electrical switching apparatus as set forth in claim 6 in which the extension means is self-retained to said switches.

* * * * *